US007549737B2

(12) United States Patent
Kwon et al.

(10) Patent No.: US 7,549,737 B2
(45) Date of Patent: Jun. 23, 2009

(54) PIEZOELECTRIC INKJET PRINTHEAD HAVING A UNIDIRECTIONAL SHUTTER

(75) Inventors: Kye-si Kwon, Seoul (KR); Seong-jin Kim, Seongnam-si (KR); Seung-joo Shin, Seoul (KR); Gee-young Sung, Daegu-si (KR); Keon Kuk, Yongin-si (KR); Mi-jeong Song, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 409 days.

(21) Appl. No.: 11/239,104

(22) Filed: Sep. 30, 2005

(65) Prior Publication Data

US 2006/0092236 A1 May 4, 2006

(30) Foreign Application Priority Data

Nov. 4, 2004 (KR) ..... 10-2004-0089212

(51) Int. Cl.
*B41J 2/045* (2006.01)

(52) U.S. Cl. ..... 347/68

(58) Field of Classification Search ..... 347/68, 347/70–72

See application file for complete search history.

(56) References Cited

U.S. PATENT DOCUMENTS 6,003,971 A 12/1999 Hanks et al. ..... 347/43
6,364,468 B1 * 4/2002 Watanabe et al. ..... 347/68
6,431,689 B1 8/2002 Schippers
6,955,418 B2 * 10/2005 Ito ..... 347/68
7,159,970 B2 * 1/2007 Watanabe ..... 347/68
2005/0019180 A1 * 1/2005 Seto et al. ..... 417/413.1

FOREIGN PATENT DOCUMENTS

EP 0 816 088 A1 1/1998
EP 0 976 561 A2 2/2000
EP 0 976 561 A3 2/2000
EP 1 652 672 A1 5/2006
JP 61-175045 8/1986

* cited by examiner

*Primary Examiner*—An H Do
(74) *Attorney, Agent, or Firm*—Lee & Morse, P.C.

(57) ABSTRACT

A piezoelectric inkjet printhead including a reversible shutter disposed in an ink flow path is disclosed. The inkjet printhead may includes a plurality of ink pressure chambers, a plurality of piezoelectric actuators to provide the plurality of ink pressure chambers with a driving force for ink ejection, an ink manifold to supply the plurality of pressure chambers, a plurality of restrictors disposed in the ink flow path between the manifold and the plurality of pressure chambers, a plurality of ink ejecting nozzles coupled to the plurality of pressure chambers, and a plurality of unidirectional shutters. The shutters may be disposed at respective outlets of the plurality of restrictors and may be adapted to open the restrictor when ink is supplied from the restrictor to the pressure chamber and close the restrictor and restrict or prevent the backflow of ink when ink is ejected from the pressure chamber through the nozzle.

18 Claims, 6 Drawing Sheets

PIEZOELECTRIC INKJET PRINTHEAD HAVING A UNIDIRECTIONAL SHUTTER

BACKGROUND OF THE INVENTION

1. Field of the Invention

The present invention relates to an inkjet printhead. More particularly, the present invention relates to a piezoelectric inkjet printhead that can reduce a volume of a pressure chamber to increase a number of channels per inch (CPI).

2. Description of the Related Art

In general, inkjet printheads are devices for printing a predetermined color image by ejecting a small volume of droplet of printing ink at a desired position on a print medium, such as a sheet of paper or a fabric. Inkjet printheads are largely categorized into two types, depending on the ink ejection mechanism used. A first type is a thermal inkjet printhead, in which a heat source is employed to form and expand bubbles in ink, causing ink droplets to be ejected. A second type is a piezoelectric inkjet printhead, in which a piezoelectric element is deformed to exert pressure on ink, causing ink droplets to be ejected.

A conventional piezoelectric inkjet printhead is illustrated in FIGS. 1 and 2. Referring to FIGS. 1 and 2, a manifold 13, a plurality of restrictors 12 and a plurality of ink chambers 11, which, in combination, constitute ink channels, are formed on a channel plate 10. A plurality of nozzles 22, corresponding to the plurality of ink chambers 11, are formed on a nozzle plate 20. A piezoelectric actuator 30 is disposed on the channel plate 10. The manifold 13 is a path through which ink introduced from an ink reservoir (not shown) is supplied to the plurality of ink chambers 11. The restrictors 12 are flow paths through which ink is introduced from the manifold 13 to the plurality of ink chambers 11. The plurality of ink chambers 11, in which ink to be ejected is contained, are typically arranged on one or both sides of the manifold 13. The driving of the piezoelectric actuator 30 causes a change in the volume of a corresponding ink chamber 11, thereby producing a pressure change in the ink chamber 11 which results in ink ejection, or ink introduction. To this end, portions of the channel plate 10 form upper walls of the ink chambers 11 and act as vibration plates 14 that are deformed by the piezoelectric actuator 30.

In the operation of a conventional piezoelectric inkjet printhead constructed as described above, as the vibration plate 14 is deformed in a downward direction by the driving of the piezoelectric actuator 30, the volume of the ink chamber 11 is reduced and an internal pressure of the ink chamber 11 is accordingly changed (i.e., the pressure in the ink chamber 11 is increased), causing ink contained in the ink chamber 11 to be outwardly ejected through the nozzle 22. Subsequently, as the vibration plate 14 returns to its original state by the driving of the piezoelectric actuator 30, the volume of the ink chamber 11 is increased and an internal pressure of the ink chamber 11 is accordingly changed (i.e., the pressure in the ink chamber 11 is reduced), causing ink to introduced to the ink chamber 11 from the manifold 13 via the restrictor 12.

When an image is printed using the conventional piezoelectric inkjet printhead having structure described above, the resolution of the image is greatly affected by the number of nozzles per inch. The number of channels per inch (CPI) generally indicates the number of nozzles per inch, and the number of dots per inch (DPI) is generally a measure of the resolution of the image.

In the conventional piezoelectric inkjet printhead illustrated in FIGS. 1 and 2, the volume of ink droplets ejected through the nozzle 22 is greatly affected by the extent of displacement of the vibration plate 14. That is, the greater the displacement of the vibration plate 14, the greater the volume of the ink droplets, and, conversely, the less the displacement of the vibration plate 14, the less the volume of the ink droplets. The displacement of the vibration plate 14 is dependent on the area of the vibration plate 14, and the area of the vibration plate 14 is dependent on the volume of the ink chamber 11. In the conventional inkjet printhead, if the vibration plate 14 is deformed by the driving of the piezoelectric actuator 30, ink is ejected through the nozzle 22. However, the ink also flows back toward the manifold 13 via the restrictor 12. Thus, due to this backflow, the displacement of the vibration plate 14 must be great enough to accommodate both the volume of the ink droplet ejected from the nozzle 22 and the volume of the ink that flows back toward the manifold 13. Accordingly, to eject ink droplets of uniform volume, the displacement of the vibration plate 14 should take into account the amount of ink backflow. Thus, the area of the vibration plate 14 and the volume of the ink chamber 11 should be such that the change in volume of the ink chamber 11, caused by the piezoelectric actuator 30 displacing the vibration plate 14, is greater than or equal to the volume of the ink droplet plus the volume of the ink backflow.

The number of CPI of the piezoelectric inkjet printhead is generally in inverse proportion to a distance DN between adjacent nozzles 22. Thus, to increase the number of CPI of the printhead, the distance DN between the adjacent nozzles 22 should be reduced. However, the conventional piezoelectric inkjet printhead having the structure described above has limitations in reducing the distance DN between the adjacent nozzles 22, for the previously mentioned reasons. That is, reducing the distance DN generally necessitates reducing the area occupied by the ink chambers 11, which in turn may require a reduction in the size of the vibration plate 14 and a concomitant reduction in the effective displacement of the vibration plate 14. Thus, increasing the CPI of the printhead may be at odds with maintaining a desired volume of ink displacement.

In another aspect of the conventional inkjet printhead, the conventional inkjet printhead typically prints an image on a sheet of paper by reciprocating in a direction orthogonal to a feed direction of the sheet, i.e., by reciprocating in a width direction of the sheet. That is, during printing, the typical inkjet printhead moves back and forth across the paper in order to print images thereon. Accordingly, the conventional inkjet printhead has a slow printing speed, due to the need to move the printhead across the width of the sheet before advancing the sheet.

Inkjet printheads having the same length as the width of a sheet of paper have recently been developed in an attempt to increase printing speed. Such printheads may have a plurality of nozzles that are arrayed across the width of the sheet of paper. This may permit the printing of an image on the sheet at high speed, without reciprocation in the width direction of the sheet. An inkjet printhead having this structure is generally known as a page-wide inkjet printhead.

However, in order to print an image with sufficiently high resolution without any reciprocation in a width direction of a printing sheet of paper, the number of CPI of the printhead needs to be equal to the number of DPI of an image. However, it is not straightforward to increase the CPI to match the desired DPI of an image. Since the conventional piezoelectric inkjet printhead has structural limitations in increasing the number of CPI for the reasons described above, it is difficult to have the same number of CPI as the number of DPI of the image.

Accordingly, to satisfy the recent demands for an image with higher resolution, continuous efforts are needed to increase the number of CPI of a printhead.

SUMMARY OF THE INVENTION

The present invention is therefore directed to an inkjet printhead having a unidirectional shutter, which substantially overcomes one or more of the problems due to the limitations and disadvantages of the related art.

It is therefore a feature of an embodiment of the present invention to provide a piezoelectric inkjet printhead employing a unidirectional shutter to restrict the backflow of ink.

It is therefore another feature of an embodiment of the present invention to provide a piezoelectric inkjet printhead having a unidirectional shutter, the piezoelectric inkjet printhead including a plurality of layers.

At least one of the above and other features and advantages of the present invention may be realized by providing a piezoelectric inkjet printhead including a plurality of ink pressure chambers, a plurality of piezoelectric actuators to provide a driving force to the plurality of ink pressure chambers, an ink manifold coupled to the plurality of ink pressure chambers via a corresponding plurality of ink flow paths, a plurality of ink ejector nozzles, wherein each ink ejector nozzle is coupled to a corresponding ink pressure chamber, and a plurality of shutters, wherein each shutter is disposed in a corresponding ink flow path, and wherein each shutter is flexible and is adapted to reversibly restrict ink flow from an ink pressure chamber in response to the driving force.

The piezoelectric inkjet printhead may include a shutter made of a thin plate, and which is deflected due to a pressure change in an ink pressure chamber caused by the driving force. The shutter may have a thickness in the range of about 1 μm to tens of μms.

The shutter may have a shape to completely cover an outlet of the restrictor, such as a rectangular shape, and may have a width less than a width of the pressure chamber, may have a width less than the width of the pressure chamber and greater than the width of the outlet and may have a length greater than a length of the outlet.

The piezoelectric inkjet printhead may have a length corresponding to a width of a print medium, and may have a plurality of ink ejector nozzles arrayed along the length of the printhead.

At least one of the above and other features and advantages of the present invention may also be realized by providing a piezoelectric inkjet printhead including a manifold layer, the manifold layer having an ink passage formed therein, a shutter layer, which may have a plurality of flexible shutters formed therein and be disposed adjacent to the manifold layer, and a pressure chamber layer, which may have a plurality of pressure chambers formed therein, wherein the pressure chamber layer may be disposed adjacent to the shutter layer such that each one of the plurality of pressure chambers communicates to the ink passage via one of a corresponding plurality of ink flow paths, and wherein each one of the plurality of flexible shutters may be disposed in a corresponding one of the ink flow paths.

The piezoelectric inkjet printhead may include a manifold layer and a pressure chamber layer formed in the same layer or in different layers. The piezoelectric inkjet printhead may also include a nozzle layer, wherein the nozzle layer has a plurality of ink nozzles formed therein, and wherein the nozzle layer is disposed directly adjacent to the manifold layer. The nozzle layer may form a wall of the ink passage.

Each one of the plurality of flexible shutters may be adapted to reversibly block a corresponding ink flow path. The shutter layer may be a metal plate and each one of the plurality of flexible shutters may be a flexible stainless steel flap. The shutter layer may also be an elastomer, and each one of the plurality of flexible shutters may be a distensible element. The manifold layer and the pressure chamber layer are formed of metal, or the manifold layer and the pressure chamber layer formed of silicon.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
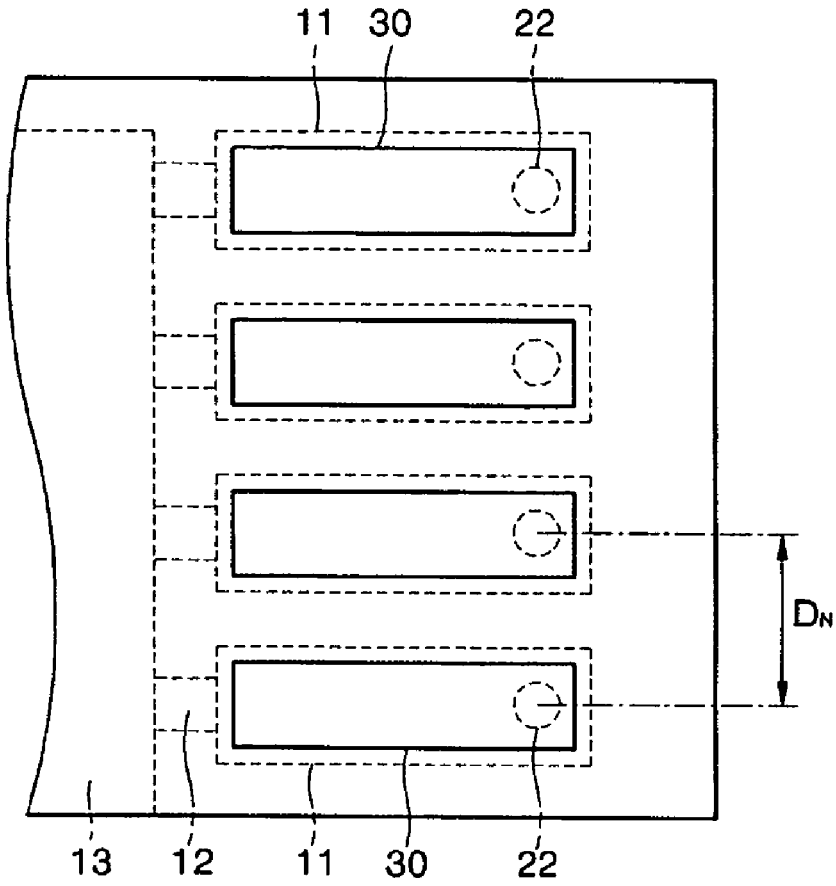
FIG. 1 (PRIOR ART)
FIG. 1 illustrates a plan view of a conventional piezoelectric inkjet printhead.
Figure 2:
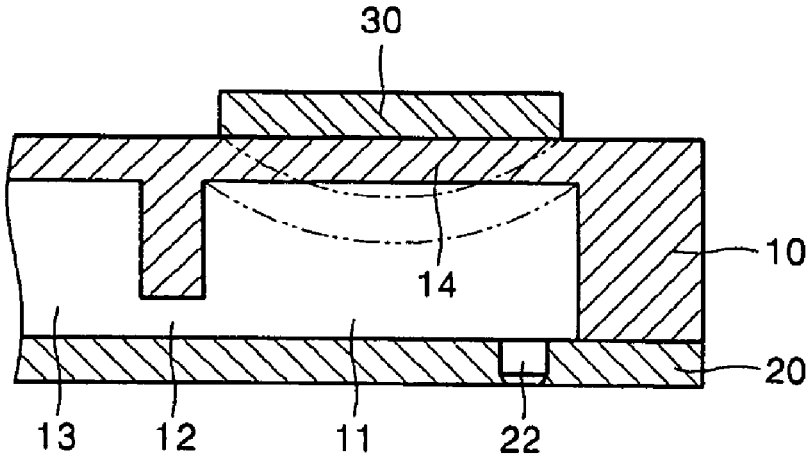
FIG. 2 (PRIOR ART)
FIG. 2 illustrates a sectional view of the conventional piezoelectric inkjet printhead shown in FIG. 1, as viewed along a longitudinal direction of a pressure chamber.

Korean Patent Application No. 10-2004-0089212, filed on Nov. 4, 2004, in the Korean Intellectual Property Office, and entitled: "Piezoelectric Inkjet Printhead Having a Unidirectional Shutter," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions may be exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 3:
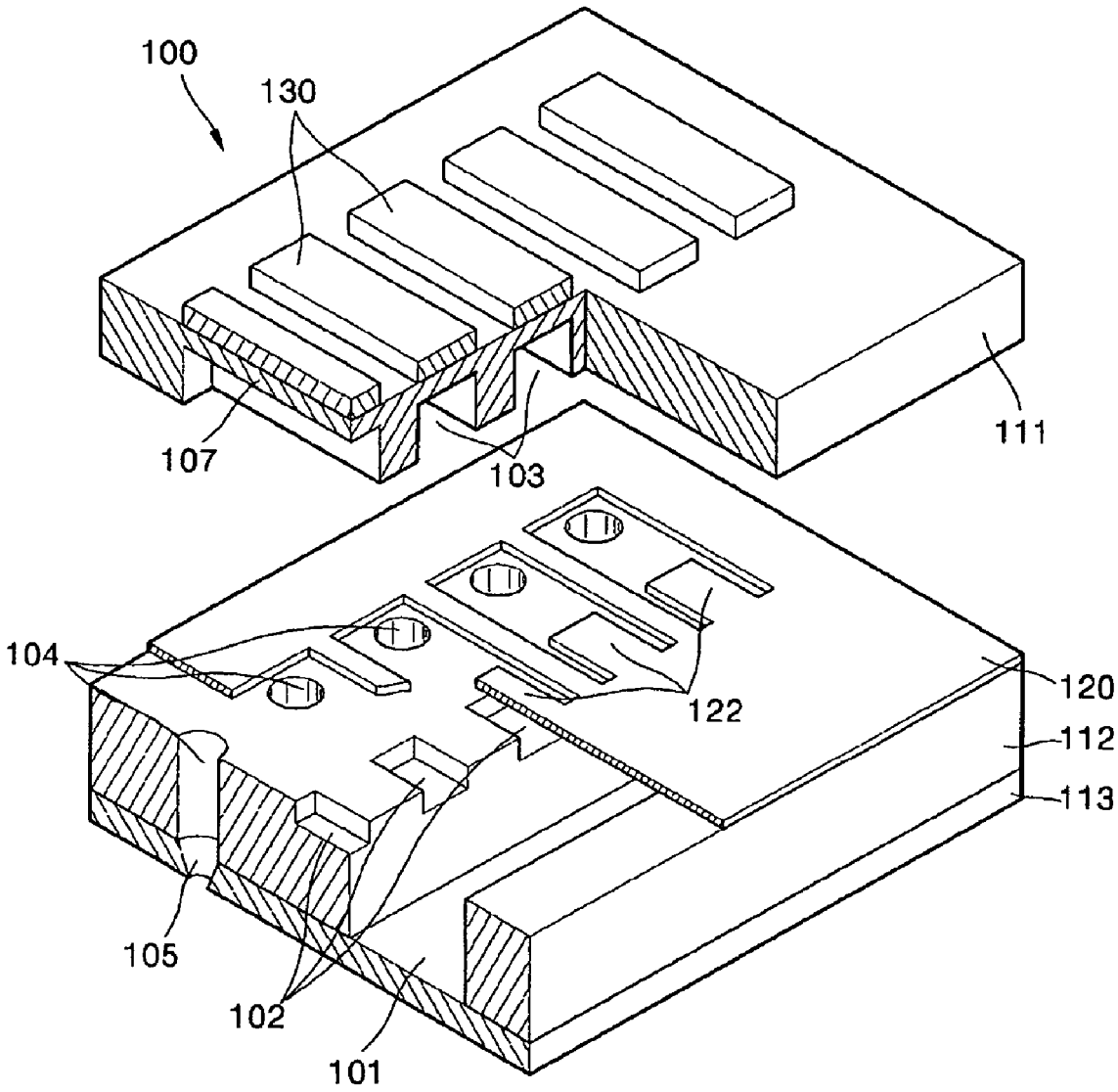
FIG. 3 illustrates a partial exploded perspective view of a piezoelectric inkjet printhead according to an embodiment of the present invention.
Figure 4:
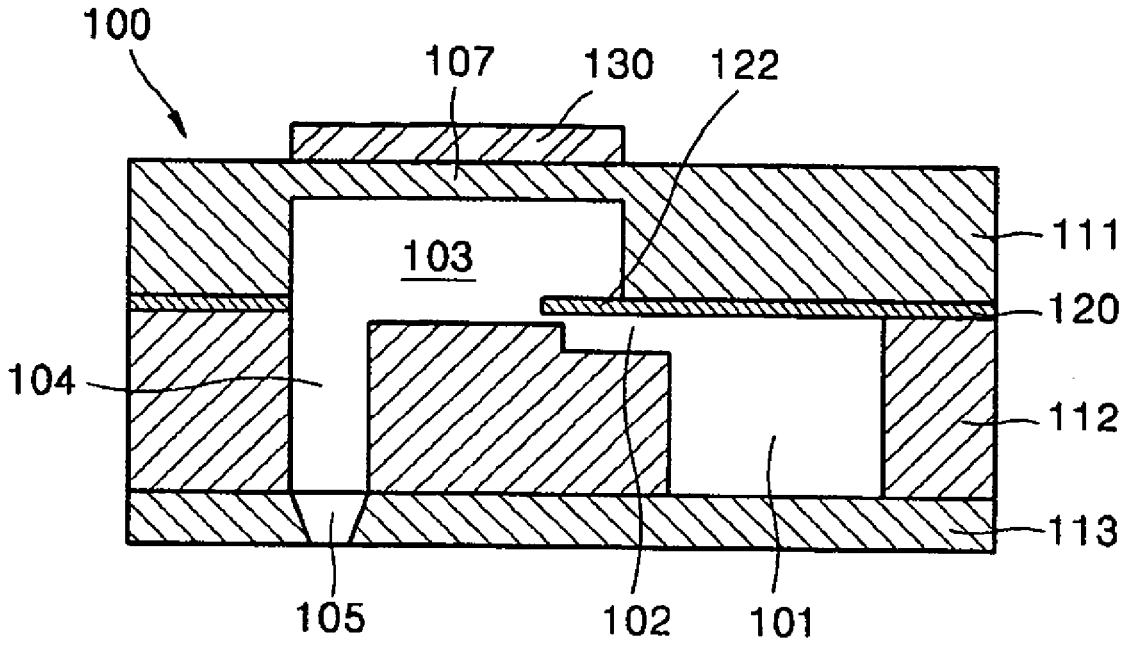
FIG. 4 illustrates a vertical sectional view of the inkjet printhead illustrated in FIG. 3.
Figure 5:
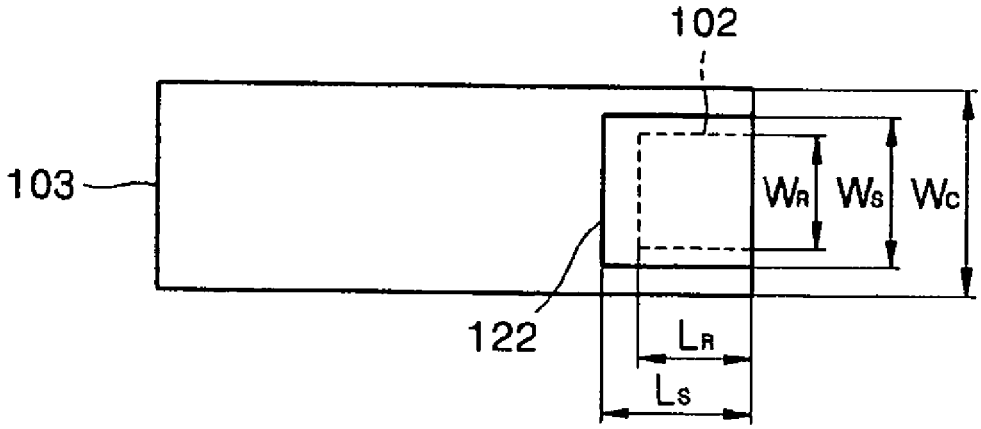
FIG. 5 illustrates a schematic view of relative dimensions of a pressure chamber, a restrictor, and a unidirectional shutter.

FIG. 3 illustrates a partial exploded perspective view of a piezoelectric inkjet printhead according to an embodiment of the present invention. FIG. 4 illustrates a vertical sectional view of the inkjet printhead illustrated in FIG. 3. FIG. 5 illustrates a schematic plan view of relative dimensions of a pressure chamber, a restrictor and a unidirectional shutter of the inkjet printhead shown in FIG. 3.

Referring to FIGS. 3 and 4, a piezoelectric inkjet printhead 100 may include ink channels including a plurality of pressure chambers 103, a piezoelectric actuator 130 providing a driving force for ink ejection to a plurality of pressure chambers 103, and a plurality of unidirectional shutters 122, which may be positioned inside the ink channels to resist a backflow of ink towards a manifold 101.

That is, the ink channels may include the plurality of pressure chambers 103, which are to contain ink to be ejected, and which are to produce a pressure change for ink ejection; a manifold 101, which is to contain ink to be supplied to the plurality of pressure chambers 103; a plurality of restrictors 102, to supply ink from the manifold 101 to the plurality of pressure chambers 103; and a plurality of nozzles 105, to eject ink from the plurality of pressure chambers 103. A plurality of dampers 104 may be disposed between the pressure chambers 103 and the nozzles 105 to focus energy, which is generated in the pressure chambers 103 by the piezoelectric actuators 130, on the nozzles 105, and to damp a sharp pressure change.

The pressure chambers 103, the manifold 101, the restrictors 102, the nozzles 105 and the dampers 104, which together constitute the ink channels, may be formed on a plurality of stacked channel plates 111 through 113. For example, the plurality of channel plates 111 through 113 may include a first channel plate 111, a second channel plate 112, and a third channel plate 113, as shown in FIGS. 3 and 4.

In detail, the plurality of pressure chambers 103 may be formed to a predetermined depth in a lower portion of the first channel plate 111. Each of the plurality of pressure chambers 103 may be parallel to one another, each having a rectangular shape, with a long dimension oriented in a direction of ink flow. Portions of the first channel plate 111 may form upper walls of the pressure chambers 103 and may act as vibration plates 107, which are deflected by the driving of the piezoelectric actuator 130.

The manifold 101 may be formed in the second channel plate 112. The manifold 101 may vertically pass through the second channel plate 112, as shown in FIGS. 3 and 4, or may be formed to a predetermined depth in an upper portion of the second channel plate 112. The plurality of restrictors 102 connecting the manifold 101 and a first end of each of the corresponding plurality of pressure chambers 103 may be formed in the second channel plate 112. The restrictors 102 may be formed to a predetermined depth in the upper portion of the second channel plate 112, as shown in FIGS. 3 and 4. Further, the plurality dampers 104 connecting the pressure chambers 103 and the nozzles 105 may pass vertically through the second channel plate 112 at positions corresponding to a second end of each of the respective plurality of pressure chambers 103.

The nozzles 105 may pass through the third channel plate 113 at positions corresponding to the dampers 104. The nozzles 105 may have a taper shape, with a decreasing section toward an outlet.

Each of the three channel plates 111 through 113, constructed as above, may be a silicon substrate. The ink channels may be formed in various ways, e.g., by micro-processing a surface of the silicon substrate through a semiconductor process. However, the present invention is not limited thereto, and each of the three channel plates 111 through 113 may be any other suitable substrate having a good processibility.

The structure described above is merely exemplary, and ink channels constituting various elements, whether combined or separately formed, may be made to take advantage of the present invention in other ways than those illustrated for the three channel plates 111 through 113. That is, ink channels having various structures can be formed in the inkjet printhead 100 according to the present invention, and ink channels may be formed in a varying number of channel plates, including more or less than three channel plates.

The piezoelectric actuators 130 may be formed on the first channel plate 111 in which the pressure chambers 103 are formed. The piezoelectric actuators 130 provide a driving force for ink ejection to the pressure chambers 103. Each of the piezoelectric actuators 130 may have a structure where a lower electrode, to act as a common electrode, a piezoelectric layer, to be deformed by applied voltage, and an upper electrode, to act as a driving electrode, are sequentially stacked on the first channel plate 111.

Each of the plurality of unidirectional shutters 122 may be installed at an outlet of each of the plurality of restrictors 102. Preferably, the unidirectional shutter 122 opens the restrictor 102 when ink is supplied from the restrictor 102 to the pressure chamber 103, and closes the restrictor 102 to restrict or prevent the backflow of ink when ink is ejected from the pressure chamber 103 through the nozzle 105. The operation of the unidirectional shutter 122 will be explained in greater detail later.

As will be apparent from the description of the present invention, if the backflow of ink is prevented by the unidirectional shutter 122, the area of the vibration plate 107 and the volume of the pressure chamber 103 needed to eject ink droplets of uniform volume may be reduced, as compared to the area and volume of vibration plates and pressure chambers in a conventional piezoelectric printhead. Accordingly, a distance between adjacent nozzles 105 may be reduced, and thus the CPI of the printhead 100 may be increased.

The plurality of unidirectional shutters 122 may be formed on a thin shutter plate 120. The shutter plate 120 may be disposed between the first channel plate 111, on which the plurality of pressure chambers 103 are formed, and the second channel plate 112, on which the plurality of restrictors 102 are formed.

The unidirectional shutter 122 may function by being deflected due to a pressure change in the pressure chamber 103, which is produced by the driving of the piezoelectric actuator 130. Accordingly, it is preferable that the unidirectional shutter 122 be suitably thin (e.g., μms to tens of μms) to be easily deflected, and should be formed in a manner such that a permanent deformation does not occur. The unidirectional shutter 122 may be made of metal with predetermined elasticity. In such an embodiment, the unidirectional shutter 122 is preferably made of stainless steel having elasticity and ink corrosion-resistance. The shutter plate 120, on which the unidirectional shutter 122 is formed, may also be a thin metal plate, and is preferably a stainless steel sheet. However, the present invention is not limited to these materials.

In an embodiment, the unidirectional shutter 122 has a shape and size to completely cover the outlet of the restrictor 102. This may restrict or completely prevent the backflow of ink. Thus, in the example shown in FIG. 5, the unidirectional shutter 122 has a shape (e.g., a rectangular shape) corresponding to the shape of the outlet of the restrictor 102. Here, the outlet of the restrictor 102 is defined as a portion where the restrictor 102 and the pressure chamber 103 overlap.

In this embodiment, the width WR of the restrictor 102 is less than the width WC of the pressure chamber 103. The width WS of the unidirectional shutter 122 is less than the width WC of the pressure chamber 103, such that the unidirectional shutter 122 can be freely deflected into the pressure chamber 103. Further, it is preferable that the width WS of the unidirectional shutter 122 be greater than the width WR of the outlet of the restrictor 102 and that a length LS of the unidirectional shutter 122 be greater than a length LR of the outlet of the restrictor 102, so that the unidirectional shutter 122 can completely cover the outlet of the restrictor 102. However, the present invention is not limited to this embodiment.

Figure 6:
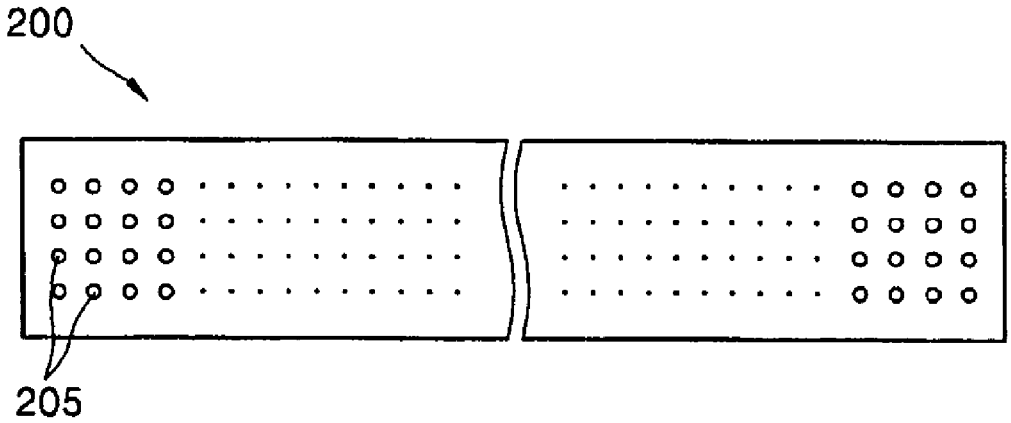
FIG. 6 illustrates a plan view of a nozzle arrangement in a piezoelectric inkjet printhead according to another embodiment of the present invention.
Figure 7:
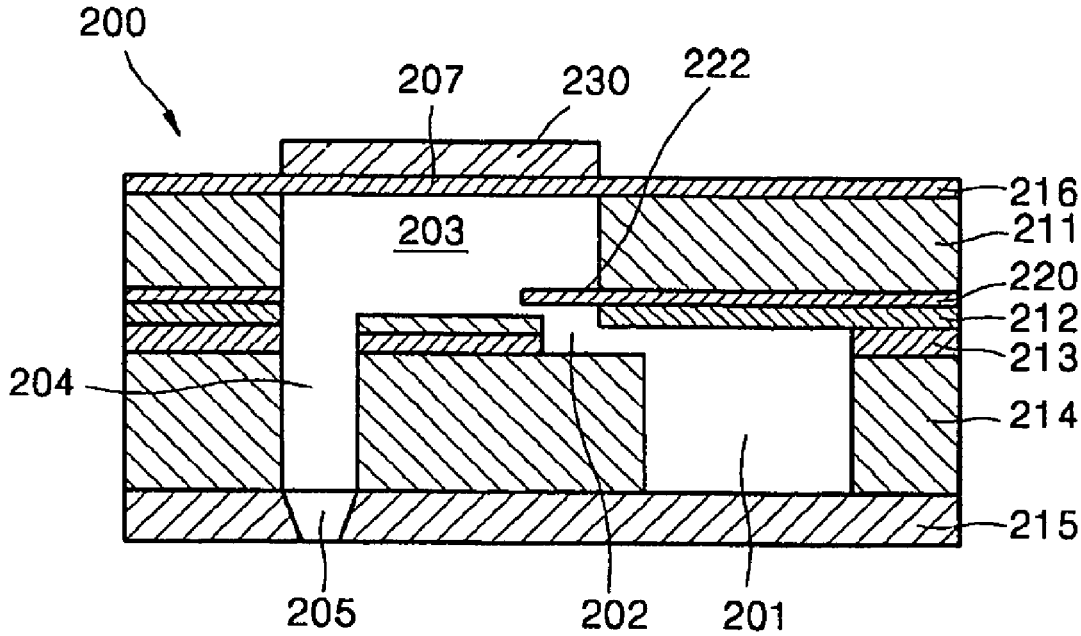
FIG. 7 illustrates a partial vertical sectional view of the inkjet printhead illustrated in FIG. 6.
Figure 8:
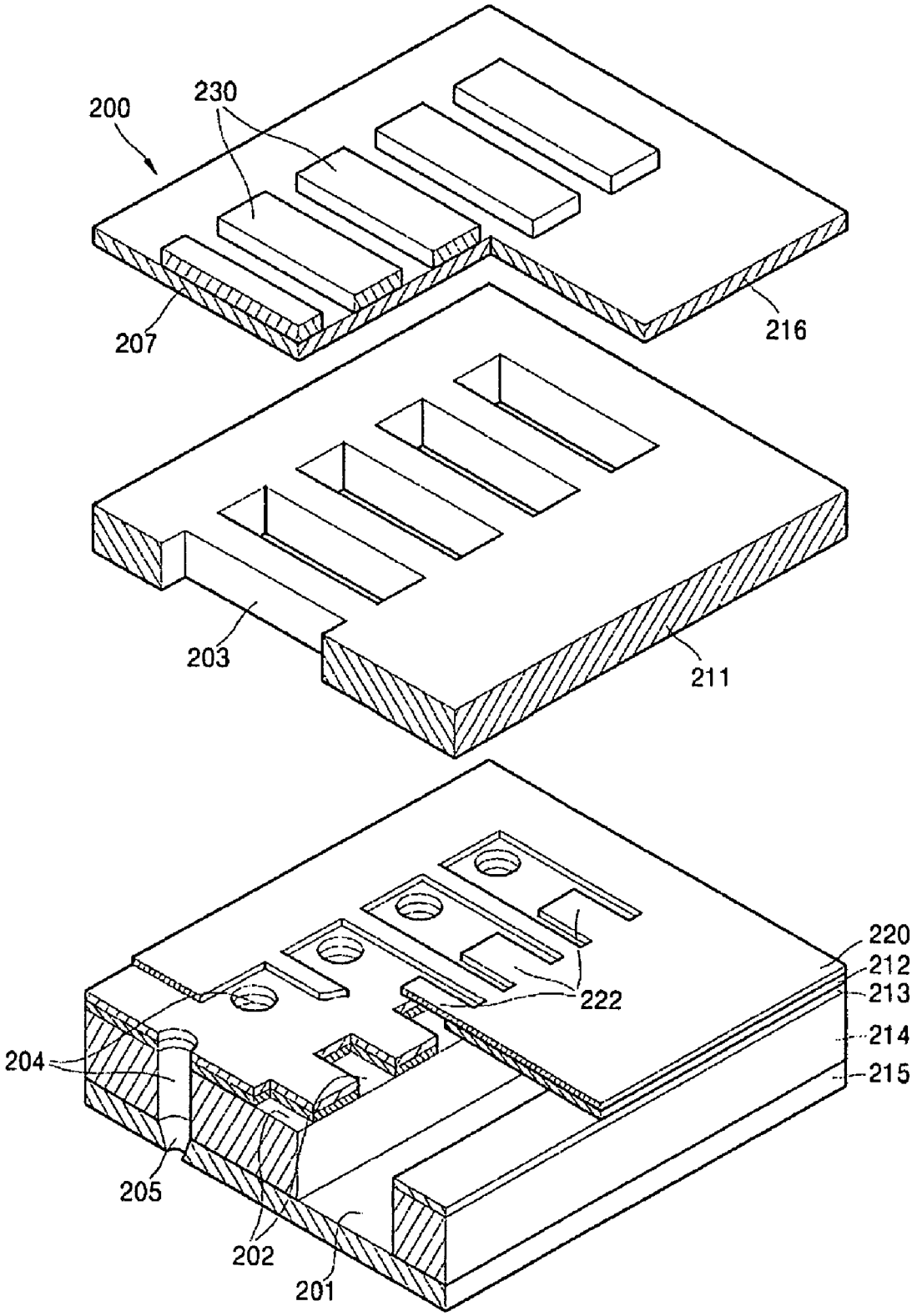
FIG. 8 illustrates a partial exploded perspective view of the inkjet printhead illustrated in FIG. 6.

FIG. 6 illustrates a plan view of a nozzle arrangement in a piezoelectric inkjet printhead according to another embodiment of the present invention. FIG. 7 illustrates a partial vertical sectional view of the inkjet printhead illustrated in FIG. 6. FIG. 8 illustrates a partial exploded perspective view of the inkjet printhead illustrated in FIG. 6.

Referring to FIG. 6, the present invention may be applied to a page-wide inkjet printhead 200. Preferably, the page-wide inkjet printhead 200 has a length corresponding to the width of a print medium, such as a sheet of paper. Here, the "width" of the printing medium is described in reference to a direction that is orthogonal to a feed direction of the printing sheet. The inkjet printhead 200 may a plurality of nozzles 205 that are arrayed in a longitudinal (i.e., lengthwise) direction of the printhead 200.

As illustrated to FIG. 7, the vertical section of the printhead 200 may be similar in structure to other embodiments of the present invention, such as the vertical section of the inkjet printhead illustrated in FIG. 4. Accordingly, in the following explanation, focus will be placed on the difference therebetween.

As illustrated to FIGS. 7 and 8, a manifold 201, a plurality of restrictors 202, a plurality of pressure chambers 203, a plurality of dampers 204, and a plurality of nozzles 205, which together constitute ink channels, may be formed on six stacked channel plates 211 through 216. In detail, the plurality of pressure chambers 203 pass through the first channel plate 211. The second channel plate 212 is attached to a bottom surface of the first channel plate 211, and the plurality of restrictors 202 pass through the second channel plate 212. Upper portions of the dampers 204 are formed in the second channel plate 212. The third channel plate 213 is attached to a bottom surface of the second channel plate 212, and an upper portion of the manifold 201 and middle portions of the dampers 204 are formed in the third channel plate 213. The fourth channel plate 214 is attached to a bottom surface of the third channel plate 213, and a lower portion of the manifold 201 and lower portions of the dampers 204 are formed in the fourth channel plate 214. The fifth channel plate 215 is attached to a bottom surface of the fourth channel plate 214, and the plurality of nozzles 205 pass through the fifth channel plate 215. The sixth channel plate 216 covering the pressure chambers 203 is attached on a top surface of the first channel plate 211. Portions of the sixth channel plate 216 act as vibration portions 207. That is, vibration portions 207 of the sixth channel plate 216 overlie the pressure chambers 203, so as to transmit a driving force from the piezoelectric actuators 230 to the pressure chambers 203. Accordingly, piezoelectric actuators 230 for deflecting the vibration portions 207 are formed on the sixth channel plate 216.

Each of the six channel plates 211 through 216 constructed as above may be a thin metal plate, preferably a stainless steel sheet with ink corrosion-resistance, to maintain the strength of the page-wide inkjet printhead 200 with a relatively great length. In this case, the ink channels can be formed in various ways, e.g., by etching, punching or laser processing the stainless steel sheets. The stainless steel sheets may be attached to one another by brazing. However, the present invention is not limited thereto, and various other suitable processing and attaching methods may be used.

The ink channel-constituting elements that are separately formed on the six channel plates 211 through 216 are exemplary and are do not limit the present invention. Thus, ink channels having various other structures may be formed in the inkjet printhead 200, and more, or less, than six channel plates may be employed.

Each of a plurality of unidirectional shutters 222, which may formed of a thin shutter plate 220, may be installed at a corresponding outlet of each of the plurality of restrictors 202 to restrict or prevent the backflow of ink. As illustrated, the shutter plate 220 is disposed between the first channel plate 211 on which the plurality of pressure chambers 203 are formed and the second channel plate 212 on which the plurality of restrictors 202 are formed. The shape, size and thickness of the unidirectional shutter 222 may be the same as those described with reference to FIGS. 3 and 4. The shutter plate 220 may be a thin metal plate, such as a stainless steel sheet, as described above.

As described above, the page-wide inkjet printhead 200 of the present invention may be more easily manufactured by stacking a plurality of stainless steel sheets. Further, a distance between adjacent nozzles 205 may be reduced by providing reduced-size pressure chambers employing the unidirectional shutter 222 of the present invention to restrict or prevent the backflow of ink. Thus, the CPI of the inkjet printhead 200 may be increased to be close to, or equal, to the DPI of an image. Accordingly, reciprocation in the width direction of the printing medium, e.g., a sheet of paper, is minimized or is not required, thereby promoting a higher printing speed.

The operation of an exemplary embodiment of a unidirectional shutter in the inkjet printhead according to the present invention will now be explained with reference to FIGS. 4, 9A and 9B. Since the operation of the unidirectional shutter may be the same in the inkjet printhead illustrated in FIG. 4 and the inkjet printhead illustrated in FIG. 7, the operation of the unidirectional shutter will be explained on the basis of the inkjet printhead illustrated in FIG. 4.

Referring to FIG. 4, when the piezoelectric actuator 130 is not driven, there is no internal pressure change in the pressure chamber 103. Accordingly the unidirectional shutter 122 is not deformed and is maintained at an even level. That is, unidirectional shutter 122 is illustrated in a resting state.

Figure 9A:
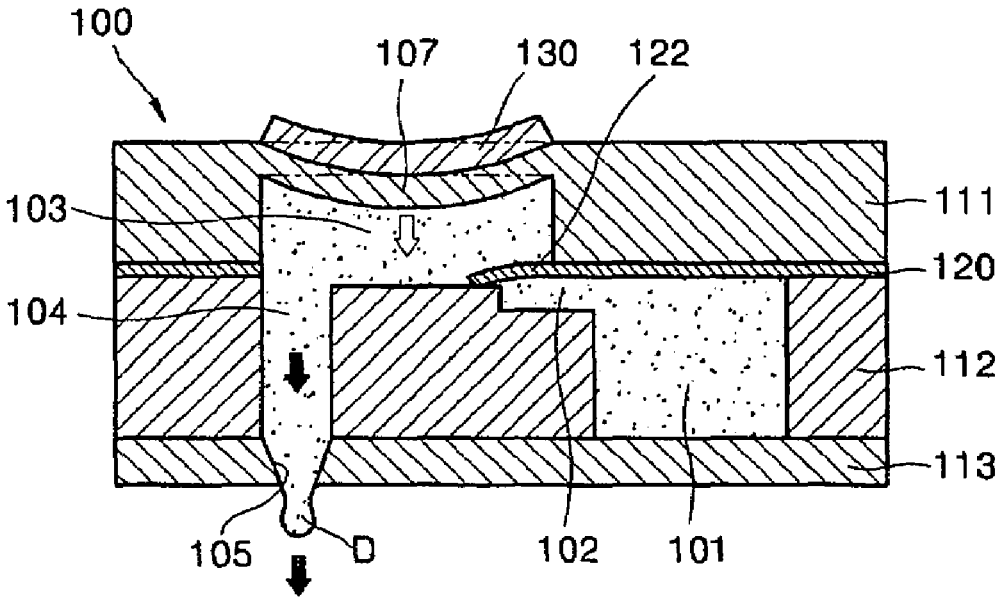
FIGS. 9A and 9B illustrate sectional views of stages of operation of a unidirectional shutter in an inkjet printhead according to an embodiment of the present invention.

Referring to FIG. 9A, if the piezoelectric actuator 130 is driven in order to eject ink, the vibration plate 107 under the piezoelectric actuator 130 is deformed and the volume of the pressure chamber 103 is reduced. An internal pressure of the pressure chamber 103 is accordingly increased, and thus ink inside the pressure chamber 103 is outwardly ejected through the damper 104 and the nozzle 105. At this time, the unidirectional shutter 122 is deflected downward due to the pressure rise in the pressure chamber 103, which results in closing the outlet of the restrictor 102, which may restrict or completely prevent the backflow of ink from the pressure chamber 103 to the restrictor 102 and/or manifold 101.

Figure 9B:
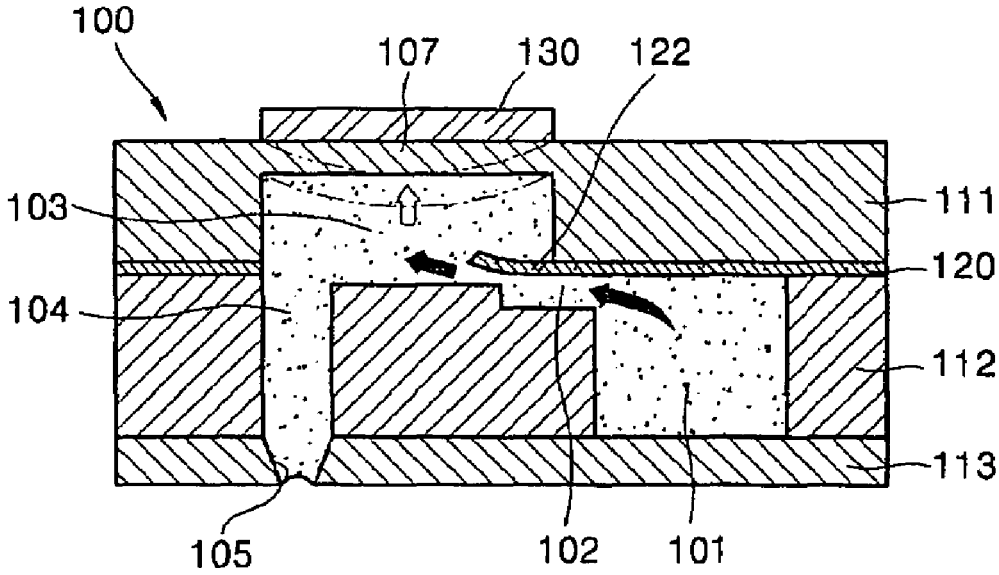

Referring to FIG. 9B, after ink is ejected, if the vibration plate 107 returns to its original state, the volume of the pressure chamber 103 is increased. Accordingly, the unidirectional shutter 122 moves upward. Unidirectional shutter may move upward due to a pressure change in the pressure chamber 103, or due to a memory effect such as results from an elastic deflection, etc. When the unidirectional shutter 122 moves upward, it opens the outlet of the restrictor 102, thereby permitting ink stored in the manifold 101 to be introduced into the pressure chamber 103 through the restrictor 102.

As described above, since the unidirectional shutter 122 of the inkjet printhead 100 is reversibly deflected upon a pressure change in the pressure chamber 103, it acts to close or open the outlet of the restrictor 102, and, accordingly, the backflow of ink may be restricted or prevented, while ink may be smoothly supplied. Further, since the backflow of ink may be restricted or prevented by the unidirectional shutter, the area of the vibration plate and the volume of the pressure chamber needed to eject ink droplets of uniform volume may be reduced. Consequently, a piezoelectric inkjet printhead according to the present invention may have a greater number of CPI than that of a conventional inkjet printhead. Thus, a page-wide inkjet printhead with a higher printing speed may be more easily realized, and may be more easily manufactured by stacking a plurality of stainless steel sheets.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims. Thus, for example, unidirectional shutters may be made of any flexible material, suitable for inkjet print heads, including various metals, elastomers, etc. Further, unidirectional shutters may be made in any configuration adapted to restrict or prevent the flow of ink from the pressure chamber to the manifold, including flaps, reed valves, distendable bubbles and other structures that flap, bend, distort or otherwise move in a reversible manner. Unidirectional shutters may also be disposed directly in, or merely adjacent to, ink flow paths, or in any similar configuration suited to reversibly restricting the flow of ink from one portion of the inkjet printhead to another. Thus, unidirectional shutters may be disposed along a wall of an ink flow path, and an entrance to an ink chamber, at an exit from an ink chamber, etc.

What is claimed is:

1. A piezoelectric inkjet printhead, comprising:

a plurality of ink pressure chambers;

a plurality of piezoelectric actuators to provide a driving force to the plurality of ink pressure chambers;

an ink manifold coupled to the plurality of ink pressure chambers via a corresponding plurality of ink flow paths;

a plurality of ink ejector nozzles, wherein each ink ejector nozzle is coupled to a corresponding ink pressure chamber; and a plurality of shutters, wherein each shutter is disposed in a corresponding ink flow path and has a shape to completely cover an outlet of a restrictor, the outlet having a smaller width than a width of the pressure chamber, wherein each shutter is flexible and is adapted to reversibly restrict ink flow from an ink pressure chamber in response to the driving force, and wherein the shutter has a smaller width than the width of the pressure chamber and a greater width than the width of the outlet.

2. The piezoelectric inkjet printhead as claimed in claim 1, wherein the shutter is made of a thin plate and is deflected due to a pressure change in an ink pressure chamber caused by the driving force.

3. The piezoelectric inkjet printhead as claimed in claim 2, wherein the shutter has a thickness in the range or about 1 μm to tens of μms.

4. The piezoelectric inkjet printhead as claimed in claim 1, wherein the shutter has a rectangular shape.

5. The piezoelectric inkjet printhead as claimed in claim 1, wherein the shutter has a length greater than a length of the outlet.

6. The piezoelectric inkjet printhead as claimed in claim 1, wherein the printhead has a length corresponding to a width of a print medium, and the plurality of ink ejector nozzles is arrayed along the length of the printhead.

7. A piezoelectric inkjet printhead, comprising:

a manifold layer, the manifold layer having an ink passage therein;

a shutter layer on the manifold layer, the shutter layer having a plurality of flexible shutters therein; and a pressure chamber layer on the shutter layer, the pressure chamber layer having a plurality of pressure chambers therein, each one of the plurality of pressure chambers being in communication with the ink passage via one of a corresponding plurality of restrictors, wherein each one of the plurality of flexible shutters is adjacent to a corresponding restrictor and has a shape to completely cover an outlet of a restrictor, the outlet having a smaller width than a width of the pressure chamber, wherein each flexible shutter includes a deflectable end adapted to deflect toward the corresponding restrictor in response to a driving force to restrict ink flow from the pressure chamber to the ink passage, and wherein the shutter has a smaller width than the width of the pressure chamber and a greater width than the width of the outlet.

8. The piezoelectric inkjet printhead of claim 7, wherein the manifold layer and the pressure chamber layer are formed in the same layer.

9. The piezoelectric inkjet printhead of claim 7, wherein the manifold layer and the pressure chamber layer are formed in different layers.

10. The piezoelectric inkjet printhead of claim 7, further comprising:

a nozzle layer, wherein the nozzle layer has a plurality of ink nozzles formed therein, and wherein the nozzle layer is disposed directly adjacent to the manifold layer.

11. The piezoelectric inkjet printhead of claim 10, wherein the nozzle layer forms a wall of the ink passage.

12. The piezoelectric inkjet printhead of claim 7, wherein each one of the plurality of flexible shutters is adapted to reversibly block a corresponding restrictor.

13. The piezoelectric inkjet printhead as claimed in claim 7, wherein the shutter layer is a metal plate.

14. The piezoelectric inkjet printhead as claimed in claim 13, wherein each one of the plurality of flexible shutters is a flexible stainless steel flap.

15. The piezoelectric inkjet printhead as claimed in claim 7, wherein the shutter layer is an elastomer.

16. The piezoelectric inkjet printhead as claimed in claim 15, wherein each one of the plurality of flexible shutters is a distensible element.

17. The piezoelectric inkjet printhead as claimed in claim 7, wherein the manifold layer and the pressure chamber layer are formed of metal.

18. The piezoelectric inkjet printhead as claimed in claim 7, wherein the manifold layer and the pressure chamber layer formed of silicon.

* * * * *